US008931540B2

(12) United States Patent
Filko

(10) Patent No.: US 8,931,540 B2
(45) Date of Patent: Jan. 13, 2015

(54) WINDOW TREATMENT HAVING AN ADJUSTABLE BOTTOM BAR

(71) Applicant: Lutron Electronics Co., Inc., Coopersburg, PA (US)

(72) Inventor: Brian J. Filko, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 17 days.

(21) Appl. No.: 13/798,854

(22) Filed: Mar. 13, 2013

(65) Prior Publication Data

US 2014/0262079 A1 Sep. 18, 2014

(51) Int. Cl.

| | |
|---|---|
| ***E06B 9/38*** | (2006.01) |
| ***E06B 9/56*** | (2006.01) |
| ***E06B 9/40*** | (2006.01) |
| ***E06B 9/322*** | (2006.01) |
| ***E06B 9/326*** | (2006.01) |
| *E06B 9/388* | (2006.01) |

(52) U.S. Cl.

CPC ... *E06B 9/56* (2013.01); *E06B 9/40* (2013.01); *E06B 9/322* (2013.01); *E06B 9/326* (2013.01); *E06B 9/388* (2013.01); *E06B 2009/3225* (2013.01); *E06B 2009/3227* (2013.01)

USPC ..... 160/173 R; 160/84.06

(58) Field of Classification Search

USPC ..... 160/168.1 R, 170, 171, 178.1 R, 173 R, 160/84.04, 84.05, 84.06

See application file for complete search history.

(56) References Cited

U.S. PATENT DOCUMENTS

| | | | | | |
|---|---|---|---|---|---|
| 3,280,890 | A * | 10/1966 | Preziosi | 160/168.1 R |
| 4,557,309 | A * | 12/1985 | Judkins | 160/84.06 |
| 4,673,018 | A * | 6/1987 | Judkins | 160/84.06 |
| 4,727,921 | A * | 3/1988 | Vecchiarelli | 160/168.1 R |
| 4,762,159 | A * | 8/1988 | Ford | 160/84.06 |
| 5,518,057 | A * | 5/1996 | Huang | 160/178.1 R |
| 5,699,847 | A * | 12/1997 | Villette et al. | 160/84.02 |
| 5,927,366 | A * | 7/1999 | Bryant | 358/1.15 |
| 6,053,236 | A * | 4/2000 | Judkins et al. | 160/168.1 R |
| 6,059,004 | A * | 5/2000 | Oskam | 160/84.04 |
| 6,085,823 | A * | 7/2000 | Oskam | 160/172 R |
| 6,095,222 | A * | 8/2000 | Voss | 160/84.05 |
| 6,550,522 | B1 * | 4/2003 | Lennon et al. | 160/168.1 R |
| 6,571,854 | B1 * | 6/2003 | Palmer et al. | 160/178.2 |
| 7,331,370 | B1 * | 2/2008 | Militello et al. | 160/170 |
| 7,730,926 | B2 * | 6/2010 | Moriya et al. | 160/84.06 |
| 7,766,068 | B2 * | 8/2010 | Andersen | 160/173 R |
| 7,832,450 | B2 * | 11/2010 | Brace et al. | 160/84.05 |
| 2004/0238132 | A1 * | 12/2004 | Hsu | 160/173 R |
| 2005/0224191 | A1 * | 10/2005 | Nien | 160/173 R |
| 2006/0243399 | A1 * | 11/2006 | Nien et al. | 160/173 R |
| 2008/0121350 | A1 * | 5/2008 | Cheng | 160/170 |
| 2012/0312486 | A1 | 12/2012 | Spray | |

* cited by examiner

*Primary Examiner* — David Purol

(74) *Attorney, Agent, or Firm* — Condo Roccia Koptiw LLP

(57) ABSTRACT

A motorized window treatment can include a headrail that is configured to be mounted to a structure. A covering material can be attached to the headrail and configured to be raised and lowered by a pair of lift cords that are operatively attached to a lift mechanism. The treatment can also include a bottom bar that is attached to an opposite end of the covering material as the headrail. The bottom bar can define a channel, which can house a sliding member that is configured to move along the bottom bar and is coupled to the ends of the lift cords. By sliding along the channel, the sliding member allows the lengths of the lift cords to change with respect to one another such that when a force is applied to the bottom bar the bottom bar will move from an unleveled position to a leveled position.

38 Claims, 13 Drawing Sheets

WINDOW TREATMENT HAVING AN ADJUSTABLE BOTTOM BAR

BACKGROUND

Window treatments typically include a flexible fabric or other means for covering a window in order to block or limit the daylight entering a space and to provide privacy. The window treatments for some covering materials, such as, cellular shades, Roman shades, and Venetian blinds, can include for example two to five parallel lift cords extending from a bottom bar to spools on a lift mechanism around which the lift cords are adapted to wrap. The lift mechanism may be rotated in a first rotational direction to wrap the lift cords around the spools and thus raise the bottom bar. The covering material collects on top of the bar as the bottom bar is raised, thus exposing the window and allowing daylight to enter the space. The lift mechanism may be rotated in a second rotational direction to unwrap the lift cords from around the spools and thus lower the bottom bar.

If the amounts of the lift cords that extend from the bottom bar to the respective spools on the lift mechanism are different from one another, the bottom bar may appear unlevel to an observer when viewed from the inside or the outside of the window. Accordingly, it is desirable to adjust the amount of the lift cords that extend between the spools on the lift mechanism and the bottom bar to be able to level the bottom bar. However, prior art methods of leveling the bottom bar involved difficult and/or inaccurate procedures, such as tying and retying knots and moving clamps, and sometimes required the bottom bar to be unassembled, which often required the use of tools.

SUMMARY

The present invention provides a window treatment allowing for easy leveling of a bottom bar of the window treatment without the use of tools and without requiring any portion of the window treatment to be disassembled.

In accordance with an embodiment, a window treatment can include a headrail that is elongate along a first direction. The headrail can be configured to be mounted to a structure and define an internal cavity. The window treatment can also include a lift mechanism that is mounted within the internal cavity and a covering material that can have a top end and a bottom end spaced from the bottom end along a second direction that is perpendicular to the first direction. The top end of the covering material can be attached to the headrail. The window treatment can also include a bottom bar attached to the bottom end of the covering material. The bottom bar can have a bar body that defines a first bar end and a second bar end that is spaced from the first bar end along a third direction. The bottom bar can define a channel that extends at least partially through the bar body along the third direction.

The window treatment can further include a sliding member moveable within the channel along the third direction. The sliding member can include a member body that defines a first member end and a second member end spaced from the first member end along the third direction. The window treatment can also include a first lift cord and a second lift cord. Each of the first and second lift cords can have a first end that is operatively attached to the lift mechanism, and a respective second end that is attached to a respective one of the first and second member ends of the member body such that rotation of the lift mechanism causes the bottom bar to either move toward or away from the headrail along the second direction. The first and second bar ends can be configured to be moved relative to each other along the second direction from a first relative position to a second relative position. The movement of the first and second bar ends from the first relative position to the second relative position can cause the sliding member to move within the channel along the third direction to thereby maintain the first and second bar ends in the second relative position.

In another embodiment, a window treatment can include a headrail that is elongate along a first direction. The headrail can be configured to be mounted to a structure and define an internal cavity. The window treatment can include a lift mechanism that is mounted within the internal cavity and a covering material that can have a top end and a bottom end spaced from the bottom end along a second direction that is perpendicular to the first direction. The top end of the covering material can be attached to the headrail. The window treatment can also include a bottom bar attached to the bottom end of the covering material. The bottom bar can have a bar body that defines a first bar end and a second bar end that is spaced from the first bar end along a third direction. The bottom bar can include opposed first and second internal sidewalls that at least partially define a channel that extends at least partially through the bar body along the third direction.

The window treatment can further include a sliding member that is movable within the channel along the third direction. The sliding member can include a member body, a first biasing member that protrudes from the member body and abuts the first internal sidewall, and a second biasing member that protrudes from the member body and abuts the second internal sidewall. The window treatment can also include a first lift cord and a second lift cord. Each of the first and second lift cords can have a first end that is operatively attached to the lift mechanism, and a respective second end that is attached to the sliding member such that rotation of the lift mechanism causes the bottom bar to either move toward or away from the headrail along the second direction. The adjustment of the bottom bar from an unleveled position to a leveled position can cause the sliding member to move within the channel along the third direction from a first relative position to a second relative position. The friction between the first and second biasing members and the first and second internal sidewalls can retain the sliding member in the second relative position to thereby retain the bottom bar in the leveled position.

In another embodiment, the disclosure includes a method of adjusting the level of a bottom bar of a window treatment. The bottom bar can define a channel and the window treatment can include a sliding member movable within the channel and first and second lift cords attached to the sliding member. The method can include applying a force to the bottom bar of the window treatment to thereby move the bottom bar from an unleveled position to a leveled position. The method can also include causing the sliding member to move within the channel from a first position to a second position to thereby maintain the bottom bar in the leveled position.

BRIEF DESCRIPTION OF THE DRAWINGS

The foregoing summary, as well as the following detailed description of an example embodiment of the application, will be better understood when read in conjunction with the appended drawings, in which there is shown in the drawings example embodiments for the purposes of illustration. It should be understood, however, that the application is not limited to the precise arrangements and systems shown. In the drawings.

DETAILED DESCRIPTION OF ILLUSTRATIVE EMBODIMENTS

Figure 1A:
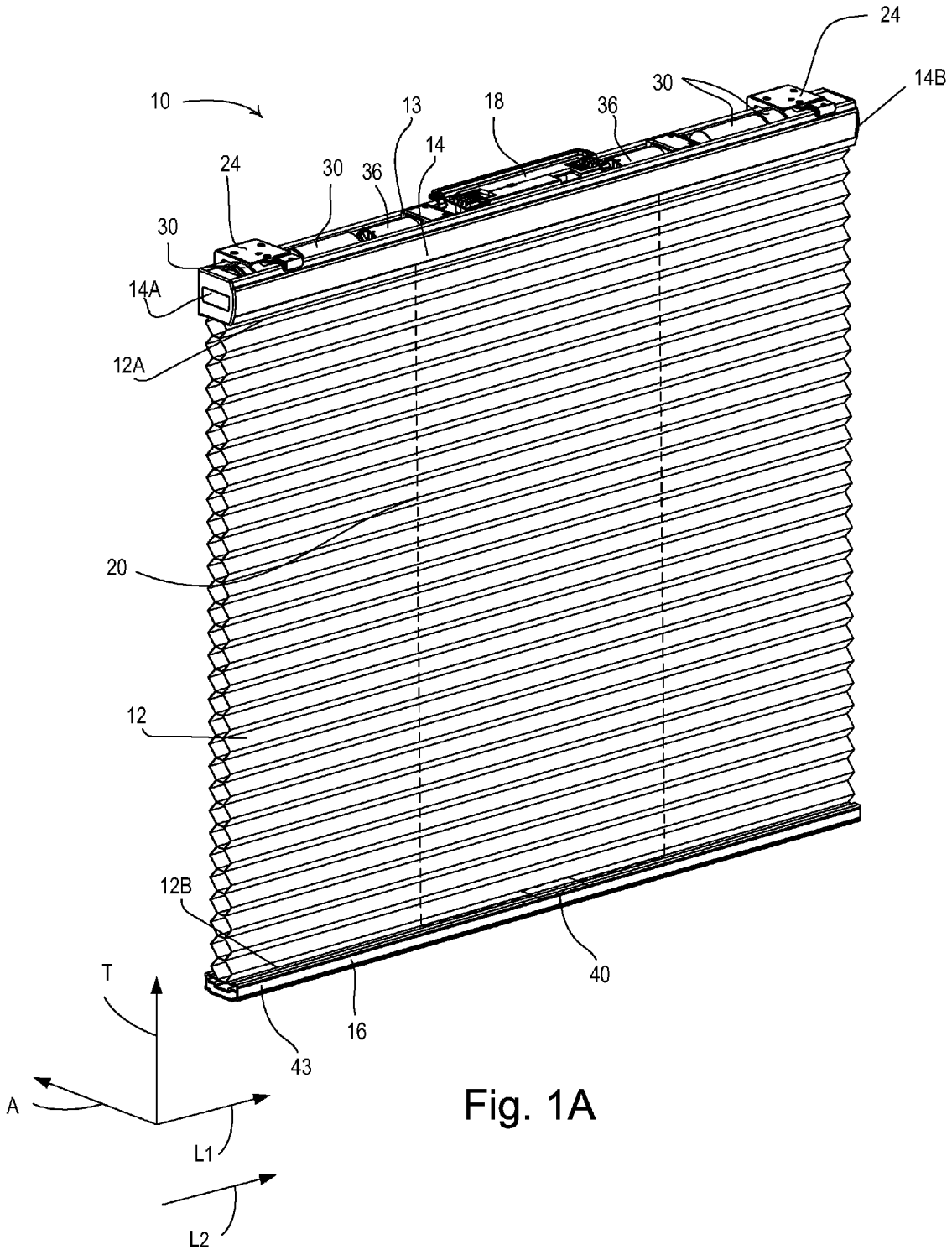
FIG. 1A is a perspective view of a battery-powered motorized window treatment in accordance with an embodiment, the motorized window treatment including a headrail, a lift mechanism mounted within the headrail, a bottom bar, a covering material attached to the headrail at a first end and to the bottom bar at a second end, first and second lift cords configured to be wound around respective lift cord spools mounted on the lift mechanism so as to move the bottom bar and thus the covering material between a raised position and a lowered position, and a sliding member slidable within a channel of the bottom bar and configured to maintain the bottom bar in a leveled position after the bottom bar has been adjusted from an unleveled position to the leveled position.

Certain terminology is used in the following description for convenience only and is not limiting. The words "right", "left", "lower", "upper", "top", or "bottom" designate directions in the drawings to which reference is made. The words "proximally" and "distally" refer to directions toward and away from, respectively, the individual operating the display unit. The terminology includes the above-listed words, derivatives thereof and words of similar import.

Referring to FIGS. 1A-1B and 2A-2B, a battery-powered motorized window treatment 10 can be configured to be coupled to or otherwise mounted to a structure, such as a window frame, wall, or other structure as desired. The motorized window treatment 10 can be customized to have any desired size, shape, and/or aesthetic look. The motorized window treatment 10 can be configured to have an internal mount (e.g., mounted within a window frame) or an external mount (e.g., mounted to the wall above the window frame). It should be appreciated, however, that the motorized window treatment 10 can be configured to have any type of mount as desired. It should also be appreciated that the motorized window treatment 10 can be mounted to the structure via any type of mounting system that is configured to support a motorized window treatment.

Figure 1B:
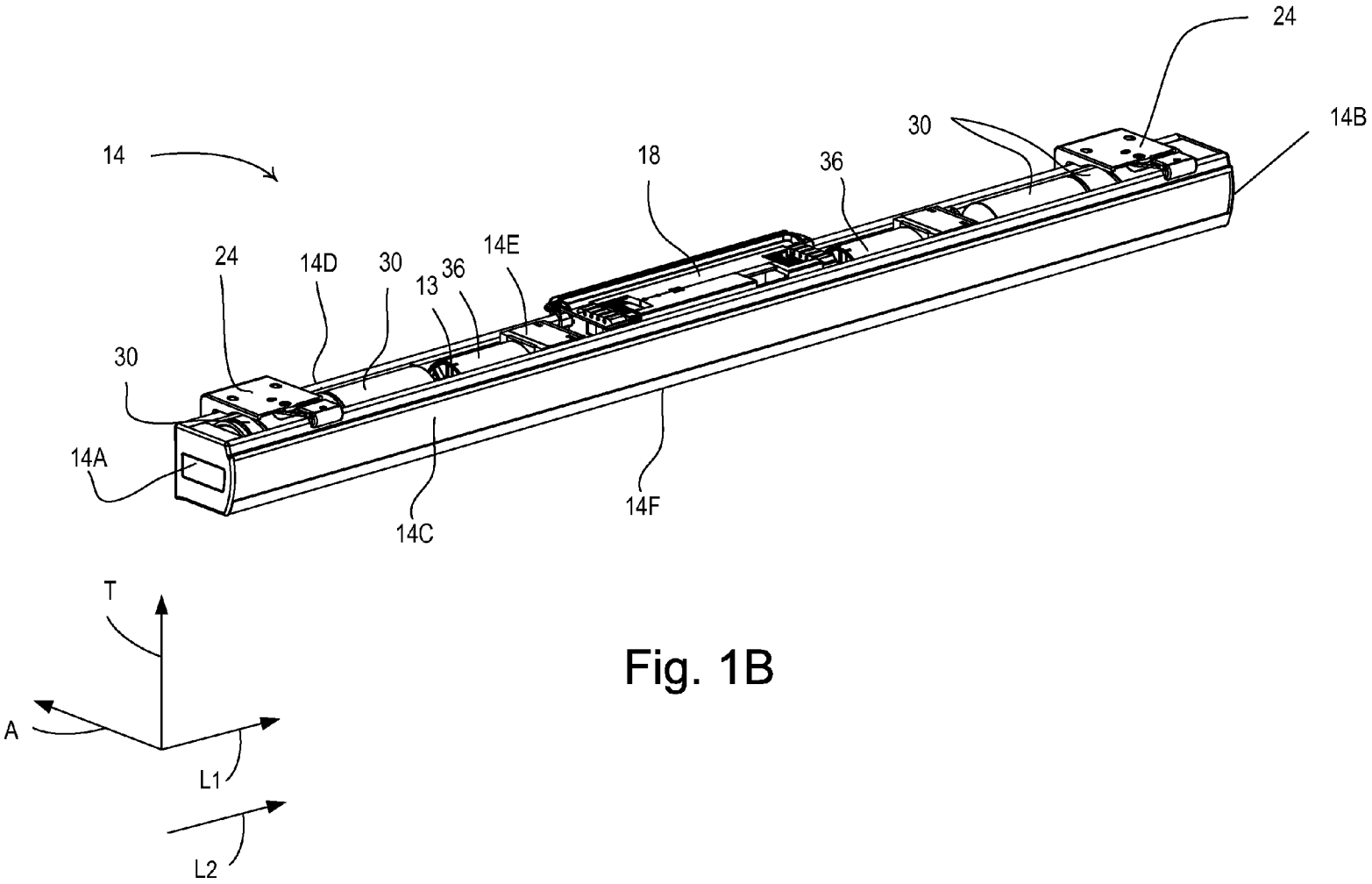
FIG. 1B is a perspective view of the headrail shown in FIG. 1A.
Figure 6A:
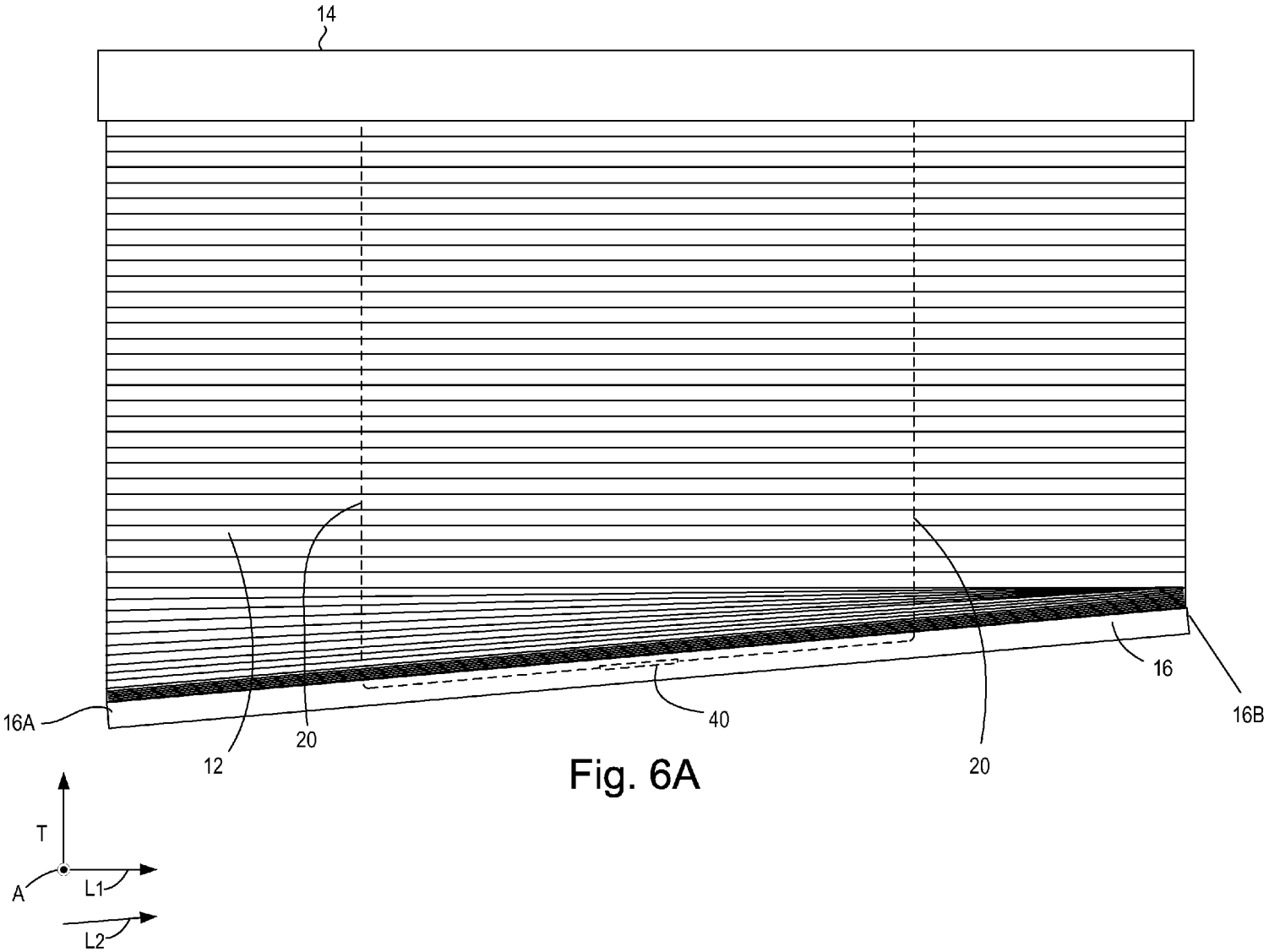
FIG. 6A is a front plan view of the motorized window treatment shown in FIG. 2A with the bottom bar configured in an unleveled position such that the bottom bar is not parallel with respect to the headrail.
Figure 6B:
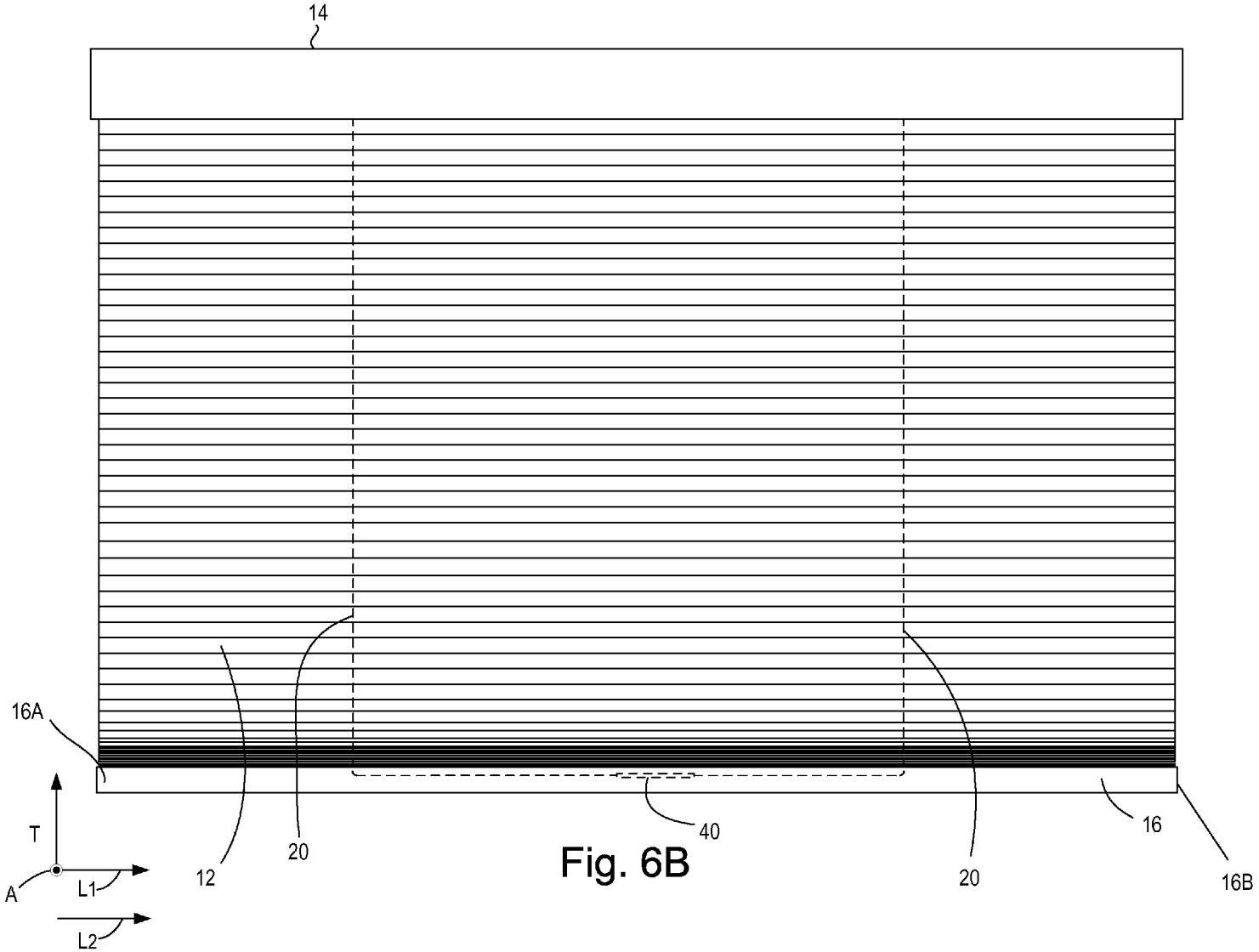
FIG. 6B is a front plan view of the motorized window treatment shown in FIG. 6A after the bottom bar has been adjusted to a leveled position such that the bottom bar is parallel with respect to the headrail.

As shown in FIGS. 1A and 1B, the motorized window treatment 10 can include a headrail 14 that is elongate along a first or longitudinal direction $L_1$. The headrail 14 can be configured to be mounted to the structure. The motorized window treatment can further include a bottom bar 16 (e.g., a weighting element), and a covering material 12, such as a cellular shade fabric as illustrated that is configured to hang in front of a window and is adjustable between a fully-open position and a fully-closed position to control the amount of daylight entering a room or space. The covering material 12 has a top end 12A connected to the headrail 14 and a bottom end 12B that is spaced from the top end 12A along a second or transverse direction T that is perpendicular to the first direction $L_1$. The bottom end 12B of the covering material 12 is attached to the bottom bar 16 such that the bottom bar 16 is elongate along a third direction $L_2$ that is substantially parallel to the first direction $L_1$ when the bottom bar 16 is in a leveled position. The bottom bar 16 is configured such that when the bottom bar 16 is in an unleveled position (as shown in FIG. 6A for example) and the third direction $L_2$ is angularly offset with respect to the first direction $L_1$, the bottom bar 16 can be adjusted to move the bottom bar 16 from the unleveled position to the leveled position (as shown in FIG. 6B). Once moved to the leveled position, the bottom bar 16 is configured to remain in the leveled position. It should be appreciated that the covering material is not limited to cellular shades as illustrated, and can be any type of material that is able to cover a window, or other structure, such as, for example, a roller shade fabric, roman shade fabric, pleated blinds and Venetian or Persian blinds.

The window treatment 10 can include two or more plastic inserts that can define a ring-like shape. The two or more plastic inserts can be mounted along the headrail 14 and the bottom bar 16 and can be configured to slidably receive a respective lift cord 20. In this manner, the two or more plastic inserts can provide structural integrity, thereby maintaining the alignment of the respective lift cord 20 along the first direction L1. It should also be appreciated that the two or more plastic inserts can define any shape suitable of being attached to the headrail 14 and bottom bar 16, and able to receive a lift cord 20.

As shown in FIG. 1B, the headrail 14 can define an internal cavity 13 that spans a majority of the length of the headrail 14. The headrail 14 can have a first headrail end 14A, a second headrail end 14B that is spaced from the first headrail end 14A along the first direction $L_1$, a front side 14C that extends between the first and second headrail ends 14A and 14B, and a back side 14D that is spaced from the front side 14C along a lateral direction A. The first and second headrail ends 14A and 14B, the front side 14C, and the back side 14D can together at least partially define the internal cavity 13. As will be described, the internal cavity 13 is sized and configured to house several of the mechanical components of the motorized window treatment 10.

As shown in FIGS. 1A and 1B, the headrail 14 can also include mounting brackets 24 that are configured to mount the headrail 14 to a desired structure. In the illustrated embodiment, the mounting brackets 24 are configured to mount the motorized window treatment 10 to a ceiling structure. It should be appreciated, however, that the mounting brackets 24 can be configured to mount the motorized window treatment 10 to any structure. For example, the mounting brackets 24 can be configured to mount the motorized window treatment 10 to a wall. In this manner, the mounting brackets 24 may include one or more holes adjacent the back side 14D of the headrail 14. The one or more holes may allow a threaded screw to pass through the mounting brackets 24 and into the wall or other structure, to thereby mount the motorized window treatment 10 to the wall or other structure.

Figure 2A:
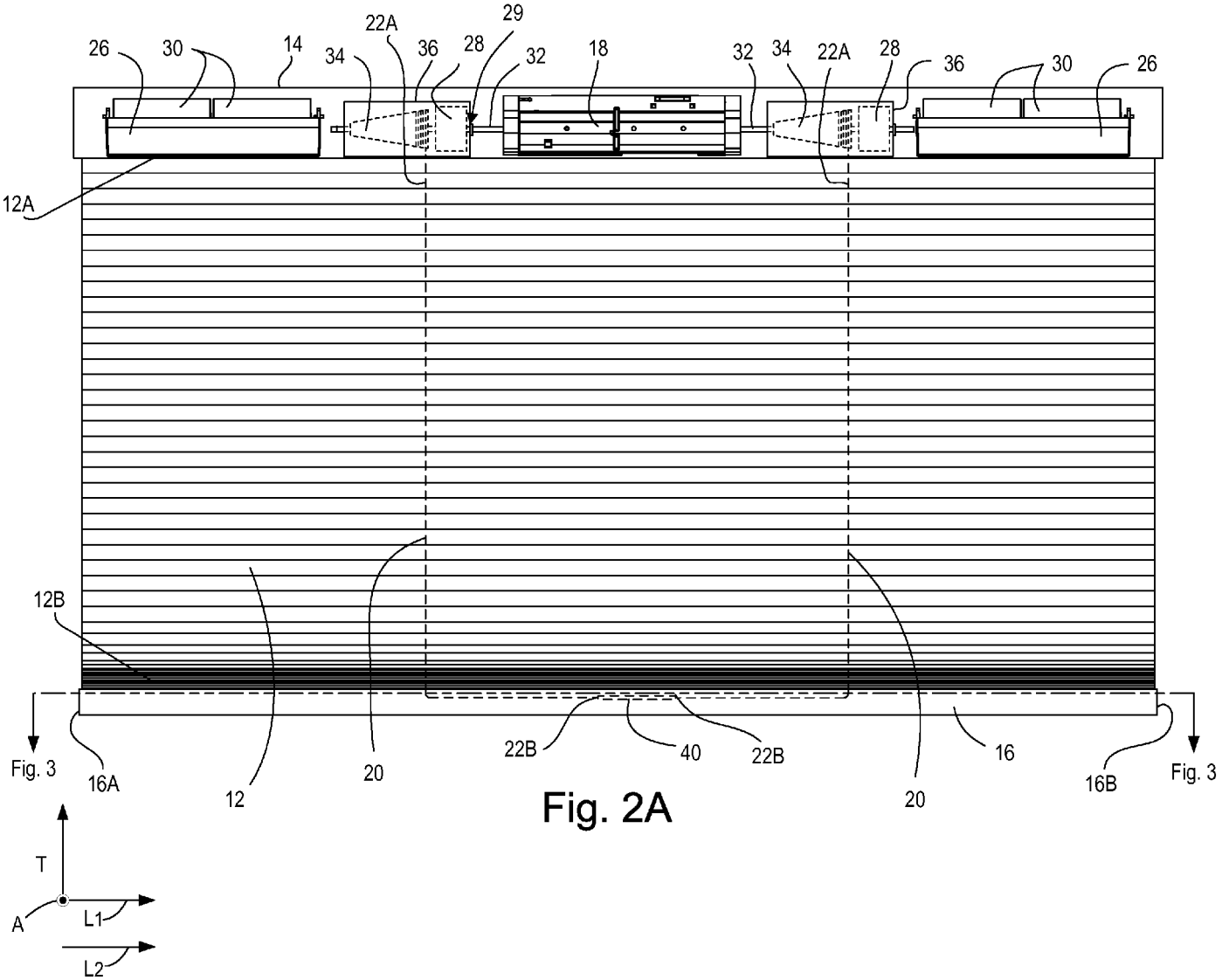
FIG. 2A is a front plan view of the battery-powered motorized window treatment shown in FIG. 1A with a front side of the headrail removed for clarity and showing a battery compartment, lift cord spools, sprint assist, and a motor drive unit of the treatment disposed within the headrail.
Figure 2B:
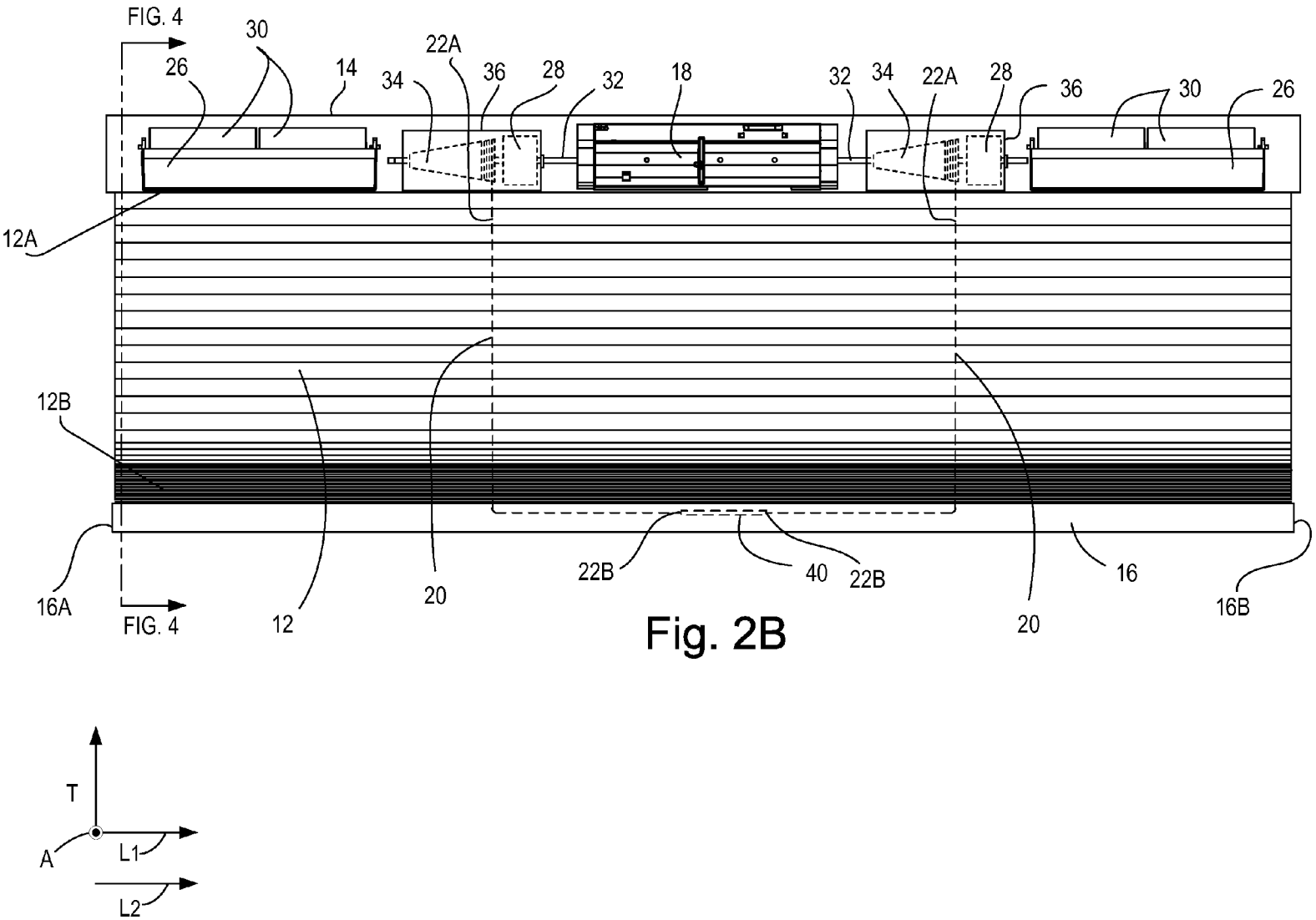
FIG. 2B is a front plan view of the motorized window treatment shown in FIG. 2A but with the covering material and bottom bar raised from a lowered position.

With continued reference to FIG. 2A, the motorized window treatment 10 can further include a motor drive unit 18 that is housed within the internal cavity 13 in the center of the headrail 14. The motor drive unit 18 can be configured to raise and lower the bottom bar 16 and the window covering 12 between the fully-open position and the fully-closed position. The motor drive unit 18 can include a motor 31 and a lift mechanism 29, illustrated as at least one drive shaft 32 that extends from the motor 31 and is driven by the motor 31. In the illustrated embodiment, the motor drive unit 18 includes two drive shafts 32, each extending from a respective side of the motor 31 along the first direction $L_1$. It should be appreciated, however, that the motor drive unit 18 can include a single drive shaft 32 that extends along the length of the headrail 14 and that the motor 31 can be located at either end 14A or 14B of the headrail 14. It should further be appreciated, that the motor drive unit 18 can have any configuration as desired and can be positioned anywhere within the internal cavity 13. It should also be appreciated that the lift mechanism can include mechanisms other than respective drive shafts. For example, the lift mechanism can be a mechanism that gathers the lift cords together and then lifts a common lift cord.

With continued reference to FIG. 2A, the motorized window treatment 10 can further include a respective lift cord spool 34 fixedly attached to each drive shaft 32, and a respective constant spring assist assembly 28 that is operatively attached to each drive shaft 32 adjacent to the lift cord spools 34. Each of the constant spring assist assemblies 28 and the adjacent lift cord spools 34 can be housed in a respective lift cord spool enclosure 36. The constant spring assist assemblies 28 can be configured to decrease the amount of power that is required to operate the motor 31. As well, in embodiments that do not have a motor 31, the spring assist assemblies 28 can be configured to reduce the amount of power that is required to raise and lower the covering material 12 and the bottom bar 16. It should be appreciated, however, that the motorized window treatment 10 can be configured such that the lift cord spools 34 and spring assist assemblies 28 are mounted on a single drive shaft 32, as desired.

As shown in FIG. 2A, the motorized window treatment 10 can further include first and second lift cords 20A and 20B each having a first end 22A operatively attached to a respective one of the drive shafts 32 such that the lift cords 20A and 20B are windingly received around the lift cord spools 34 as the drive shafts 32 are rotated to raise the window covering 12. Each lift cord 20A and 20B further includes an opposed second end 22B that is operatively attached to the bottom bar 16 such that the bottom bar 16 is raised along with the window covering 12 as the lift cords 20A and 20B are windingly received around the lift cord spools 34.

Rotation of the drive shafts 32 causes the first and second lift cords 20A and 20B to move, which in turn causes the covering material 12 and the bottom bar 16 to move along the second direction T, between the lowered position and the raised position. In other words, rotation of the at least one drive shaft 32 causes the bottom bar 16 to either move toward or away from the headrail 14 along the second direction T. Therefore, rotation of the at least one drive shaft 32 raises or lowers the covering material 12 to reveal or cover the window or other structure that the motorized window treatment 10 is adjacently mounted.

As shown in FIG. 2A, the motorized window treatment 10 can further include at least one battery, such as a plurality of batteries 30 (e.g., four, six, or eight D-cell batteries), that are electrically coupled in series. The series-combination of batteries 30 are coupled to the motor drive unit 18 and are configured to power the motor drive unit 18. The batteries 30 are housed within the internal cavity 13 of the headrail 14 so as to be out of view of a user of the motorized window treatment 10. In the illustrated embodiment, the motorized window treatment 10 includes a pair of battery compartments 26 that are located within the internal cavity 13. Each battery compartment 26 can be configured to retain two batteries 30. The battery compartments 26 can be located on either side of the motor drive unit 18 adjacent the ends 14A and 14B of the headrail 14. The batteries 30 are configured to provide the motorized window treatment 10 with a practical lifetime (e.g., approximately 3 years), and can be typical "off-the-shelf" batteries that are easy to replace. It should be appreciated, however, that the motorized window treatment 10 can include any number of, type of, and size of batteries as desired. For example, the motorized window treatment 10 can include six or eight AA batteries that are coupled in series. Therefore, it should be appreciated, that the battery compartments 26 can be configured to retain any number of, type of, and size of batteries as desired. It should also be appreciated that the plurality of batteries 30 can be mounted to an external space outside of the internal cavity 13. It should further be appreciated that the window treatment can be devoid of the plurality of batteries 30. In this manner, the window treatment 10 can draw power from another source, such as an AC power outlet. Alternatively, the window treatment 10 is non-motorized and does not draw power from any source.

Figure 3:
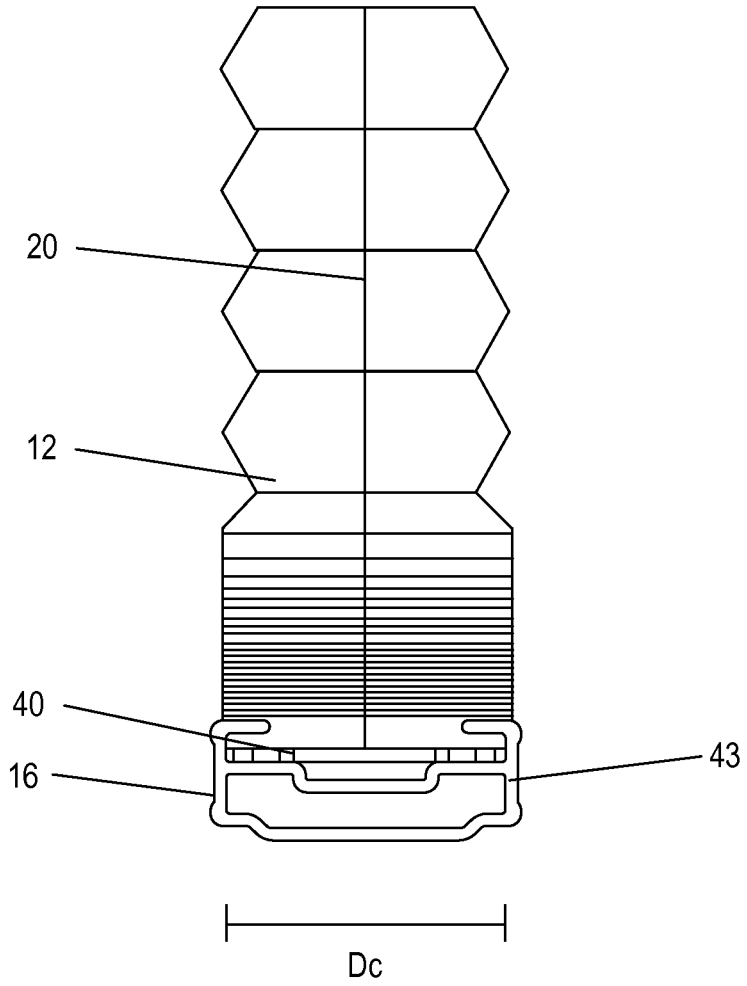
FIG. 3 is a side elevation view of the bottom bar shown in FIG. 1A with the sliding member positioned within the channel of the bottom bar.

Now in reference to FIGS. 1A and 3, the bottom bar 16 can include a bar body 43 that is elongate along the third direction $L_2$ and defines a first bar end 16A and a second bar end 16B that is spaced from the first bar end 16A along the third direction $L_2$. The bottom bar 16 can define a channel 42 that extends at least partially through the bar body 43 along the third direction $L_2$. In the illustrated embodiment, the channel 42 extends completely through the bar body 43 from the first bar end 16A to the second bar end 16B. It should be appreciated, however, that the channel 42 can extend only partially through the bar body 43 and along any portion of the bar body 43. As shown in FIG. 3, the bar body 43 includes first and second sidewalls 42A and 42B that are opposed along the lateral direction A and are spaced from each other so as to define a distance $D_C$ measured along the lateral direction A from the first sidewall 42A to the second sidewall 42B. The first and second sidewalls 42A and 42B can extend along the bar body 43 from the first bar end 16A and toward the second bar end 16B such that the first and second sidewalls 42A and 42B at least partially define the channel 42.

With continued reference to FIGS. 1A, 2A, and 3, the motorized window treatment can further include a sliding member 40 that is positioned within the channel 42 such that the sliding member 40 is movable within the channel along the third direction $L_2$. The sliding member 40 can be substantially planar and can be sized to abut the first and second sidewalls 42A and 42B of the channel 42 to thereby create a frictional force against the sidewalls 42A and 42B. The frictional force should be sufficient to maintain the sliding member 40 in a relative position along the bottom bar 16 unless a force is acted on one of the first and second ends of the bottom bar 16. It should be appreciated, however, that the sliding member 40 can have any shape and size and can be configured to abut any portion of the bottom bar 16 and the bottom end 12B of the covering material 12 to create the frictional force.

The first and second lift cords 20A and 20B can be attached to the sliding member 40 such that the lengths of the first and second lift cords 20A and 20B can be adjusted by applying a force to the bottom bar 16. Therefore, the bottom bar 16 can be configured such that the user does not have to disassemble the bottom bar 16 to adjust the length of the first and second lift cords 20A and 20B extending from the respective drive shaft 32 to the bottom bar 16. In the illustrated embodiment, no disassembly of the bottom bar 16 may be required. In essence, to adjust the position of the bottom bar 16 from an unleveled position to a leveled position, the user may apply a force along the second direction T, in the direction as indicated by the arrow T or in a direction opposite the arrow T, to any portion of the bottom bar 16. This force may move the bottom bar 16 to the leveled position. As the bottom bar 16 is moved, the sliding member 40 moves within the channel 42 and once the bottom bar 16 is in the desired position the frictional forces acting against the sidewalls 42A and 42B by the sliding member 40 will maintain the bottom bar 16 in the desired position.

Now in reference to FIGS. 3, 4A-4B, and 5A-5B, the sliding member 40 can include a member body 48 that defines a first member end 48A and a second member end 48B spaced from the first member end 48A along the third direction $L_2$. The second ends 22B of the first and second lift cords 20A and 20B can be attached to the sliding member 40 at respective ends 48A and 48B of the sliding member body 48. As shown in FIG. 2A, the second ends 22B of the first and second lift cords 20A and 20B can be attached to the first and second member ends 48A and 48B of the member body 48 such that the first and second lift cords 20A and 20B at least partially extend in opposite direction from each other along the third direction $L_2$ and within the channel 42. In this manner, the sliding member 40 may create a continuous segment between the first and second lift cords 20A and 20B. Because the sliding member 40 may be configured to move along the channel 42 of the bottom bar 16, sliding member 40 may effectively adjust the length of each of the first and second lift cords 20A and 20B with respect to one another when the bottom bar 16 is adjusted from the unleveled position to the leveled position. That is, the sliding member 40 is configured to move through the channel 42 if a user pulls or pushes on one of the bar ends 16A and 16B to adjust the levelness of the bottom bar 16. For example, if the user were to pull the second bar end 16B downwards, the amount of the second lift cord 20B that extends out of the bottom bar 16 increases in distance, such that the sliding member 40 translates toward the second bar end 16B in the channel 42. It should be appreciated that the sliding member 40 does not have to be centered between the respective first and second lift cords 20A and 20B. For example, the sliding member 40 can be located at any location along the third direction L2 between the respective first and second lift cords 20A and 20B.

As shown in FIGS. 4A, 4B, 5A, and 5B, the first member end 48A can define a first attachment member 49A that is configured to attach to the second end 22B of the first lift cord 20A and the second member end 48B can define a second attachment member 49B that is configured to attach to the second end 22B of the second lift cord 20B. The first and second attachment members 49A and 49B can each define a pair of cord slits 52 and an aperture 50 that are configured to receive the second ends 22B of the first and second lift cords 20A and 20B to thereby couple the second ends 22B to the sliding member 40. In the illustrated embodiment, the sliding member 40 has an aperture 50 located at each member end 48A and 48B and a cord slit 52 located at each of the four corners of the member body 48. Each aperture 50 may be configured to receive a respective lift cord second end 22B and the cord slits 52 may be configured to frictionally receive the lift cord second ends 22B, thus allowing each respective lift cord 20A and 20B to be coupled to the sliding member 40. It should be appreciated that the sliding member 40 can include any number of apertures 50 and cord slits 52. Further, it should be appreciated, that the attachment members 49A and 49B can have any configuration as desired so long as the attachment members 49A and 49B can attach the first and second lift cords 20A and 20B to the sliding member 40. It should also be appreciated, that the second ends 22B of the first and second lift cords 20A and 20B can be attached to any portion of the member body 48 and can extend from the member body 48 along any direction as desired. For example, in one embodiment the second ends 22B can be attached to a center of the member body 48, as desired. In another embodiment, the second ends 22B can extend from one side of the member body 48 through the aperture 50, where the second ends 22B form a knot that couples the first and second lift cords 20A and 20B to the member body 48.

Figure 4A:
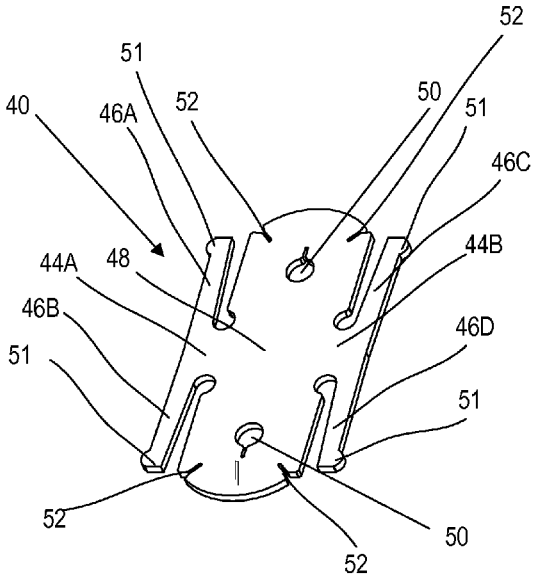
FIG. 4A is a perspective view of the sliding member.
Figure 4B:
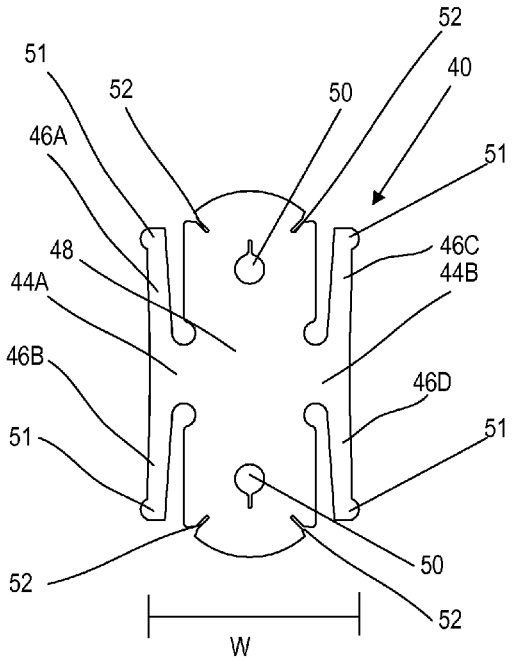
FIG. 4B is a top plan view of the sliding member shown in FIG. 4A.
Figure 5A:
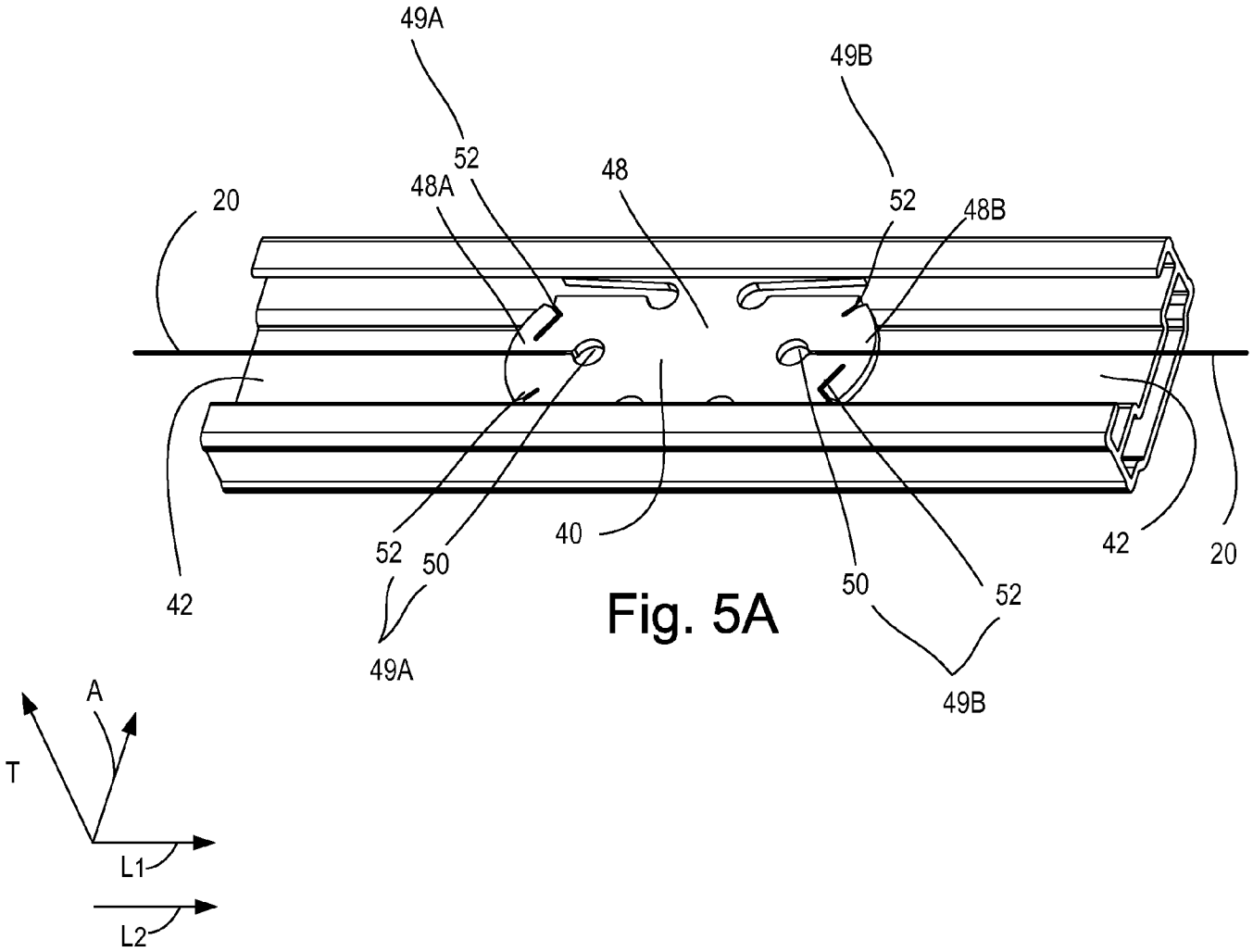
FIG. 5A is a perspective enlarged view of a portion of the bottom bar and the sliding member positioned within the channel of the bottom bar.
Figure 5B:
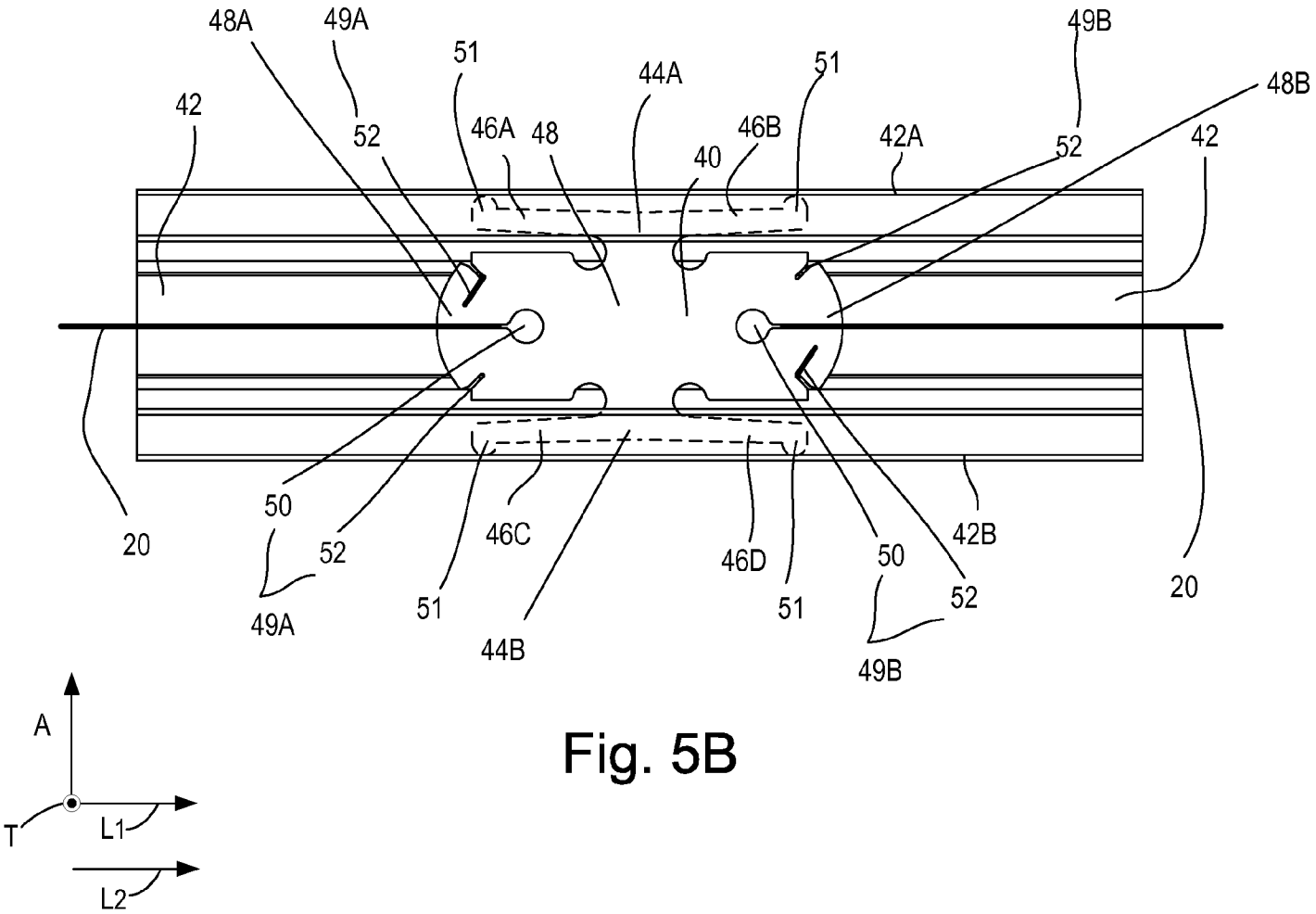
FIG. 5B is a top plan view of the bottom bar and the sliding member shown in FIG. 5A.

With continued reference to FIGS. 4A-4B, and 5A-5B, the sliding member 40 can further include a first biasing member 44A that protrudes from the member body 48 and applies a biasing force against the first sidewall 42A, and a second biasing member 44B that protrudes from the member body 48 and applies a biasing force against the second sidewall 42B. As shown in FIG. 4B the sliding member 40 can define a maximum width W measured along the lateral direction A. The maximum width W can be greater than the distance $D_C$ of the channel 42 such that when the sliding member 40 is received by the channel 42 the biasing members 44A and 44B elastically flex toward each other such that the width W of the sliding member 40 decreases and is substantially equal to the distance $D_C$. The biasing members 44A and 44B are configured to bias toward the first and second sidewalls 42A and 42B to thereby apply respective forces against the sidewalls 42A and 42B As shown in FIGS. 4A and 4B, the first and second biasing members 44A and 44B each includes at least one leg (e.g., one of legs 46A-46D) that is spaced from the member body 48 such that each leg is configured to flex toward the member body 48 when the sliding member 40 is inserted into the channel 42. As shown, the first biasing member 44A includes a pair of legs 46A, 46B that extend away from each other along the third direction $L_2$ and the second biasing member 44B includes a pair of legs 46C, 46D that extend away from each other along the third direction $L_2$. As shown in FIGS. 4A and 4B, each leg 46A-46D defines a protrusion 51 that abuts a respective one of the sidewalls 42A and 42B to thereby create a frictional force between the legs 46A-46D and the first and second sidewalls 42A and 42B. In particular, the first biasing member 44A can include first and second biasing legs 46A and 46B and the second biasing member 44B can include first and second biasing legs 46C and 46D, such that each of the biasing legs 46A-46D is configured to bias toward the channel sidewalls 42A and 42B such that the protrusions 51 abut the sidewalls 42A and 42B. In this manner, when the sliding member 40 is positioned within the channel 42, the biasing members 44, via the biasing legs 46A-46D, may produce a frictional force that acts to retain the sliding member 40 in a relative position along the channel 42 when the user is not applying force to the bottom bar 16. Therefore, the frictional force between the sliding member 40 and the first and second channel sidewalls 42A and 42B may be sufficient to maintain the position of the sliding member 40 within the channel 42 unless the first and second bottom bar ends 16A and 16B are moved relative to each other along the second direction T. It should be appreciated, however, that the biasing members 44 can have any configuration as desired. For example, the biasing members 44 can be a flexible dome that protrudes out from the member body.

In operation and in reference to FIGS. 5A and 5B and 6A and 6B, the biasing members 44, via the biasing legs 46, may be configured to apply a frictional force that is low enough such that any user may cause a force to be applied to the bottom bar 16 that may overcome the frictional force to move the sliding member 40 along the channel 42. At the same time, the biasing members 44, via the biasing legs 46, may be configured to apply a frictional force that is high enough to resist movement of the sliding member 40 during normal operation of rising and lowering of the covering material 12 and the bottom bar 16. Once the user has adjusted the position of the bottom bar 16 to the desired position, the biasing members may retain the sliding member 40 in a respective position along the bottom bar 16 due to the frictional force between the biasing members 44, via the biasing legs 46, and the first and second channel sidewalls 42A and 42B. It should be appreciated that the amount of frictional force can depend upon the size of the sliding member 40, the size of the biasing legs 46, and/or the type of material used to make the sliding member 40 and bottom bar 16.

Therefore as shown in FIGS. 6A and 6B, the bottom bar 16 can be adjusted from a first relative position as shown in FIG. 6A to a second relative position as shown in FIG. 6B by adjusting the first bottom bar end 16A and the second bottom bar end 16B, with respect to each other, along a the second direction T. In one example, the user may adjust the bottom bar 16 from a first relative position (an unleveled position), as shown in FIG. 6A, to a second relative position (a leveled position), as shown in FIG. 6B, and vice versa. When in the unleveled position, the third direction $L_2$ is angularly offset from or otherwise not parallel to the first direction $L_1$. When in the leveled position, the third direction $L_2$ is parallel to the first direction $L_1$. The movement of the first bottom bar end 16A and second bottom bar end 16B with respect to each other causes the sliding member 40 to move within the channel 42 along the third direction $L_2$. Once the sliding member 40 has moved, the friction forces will maintain the sliding member in its new position and thus maintain the bottom bar 16 in the second leveled position. It should be appreciated, however, that the first and second relative positions can be any positions as desired. For example, the second relative position does not have to be a leveled position.

Figure 7A:
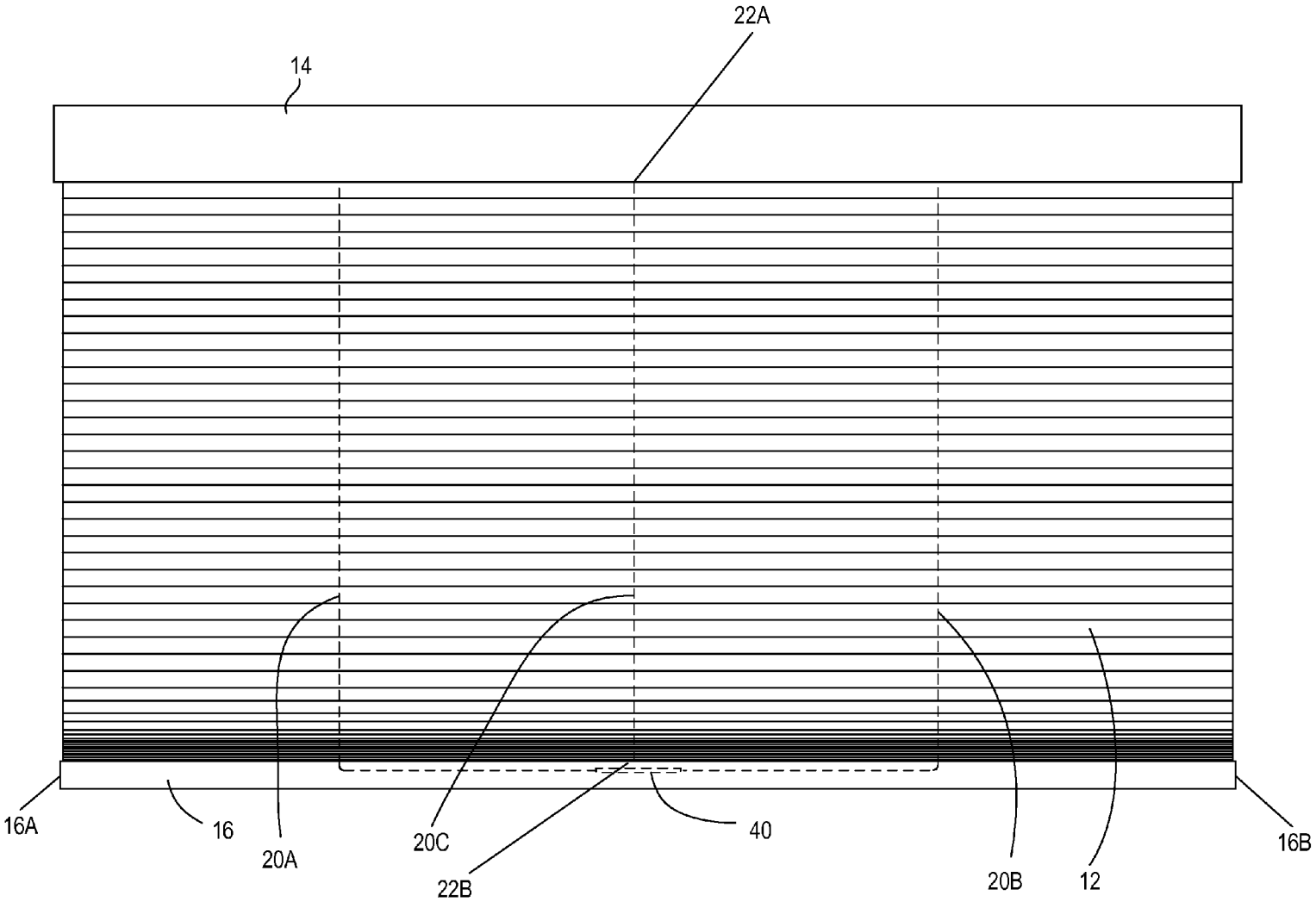
FIG. 7A is a front plan view of a battery-powered motorized window treatment in accordance with another embodiment, the motorized window treatment having three lift cords and one sliding member.

Now in reference to FIG. 7A, the window treatment shown in FIG. 2A can further include a third lift cord 20C. The third lift cord 20C can have a first end 22A that is operatively attached to the at least one drive shaft 32. Furthermore, the third lift cord 20C can have a second end 22B that is directly attached to the bottom bar 16 between the first and second lift cords 20.

The window treatment 10 as illustrated in FIG. 7A is substantially configured to perform the same functions and movements as the window treatment 10 as shown in FIG. 2A and includes like structure unless otherwise described. However, the third lift cord 20C may not be coupled to any sliding member 40 and is instead coupled to the bottom bar 16 directly. In this manner, when the bottom bar first end 16A is moved along the third direction $L_2$ with respect to the bottom bar second end 16A, the length of the third lift cord 20C as extending from its respective drive shaft 32 does not change. As such, the lengths of the first and second lift cords 20A and 20B extending from their respective drive shafts 32 change with respect to one another. In effect, the second end 22B of the third lift cord 20C acts as a pivot that the bottom bar 16 tilts about. It should be appreciated, however, that the third lift cord 20C can be attached to any intermediate structure that is between the bottom bar 16 and the lift cord 20C and still be directly coupled to the bottom bar 16.

Figure 7B:
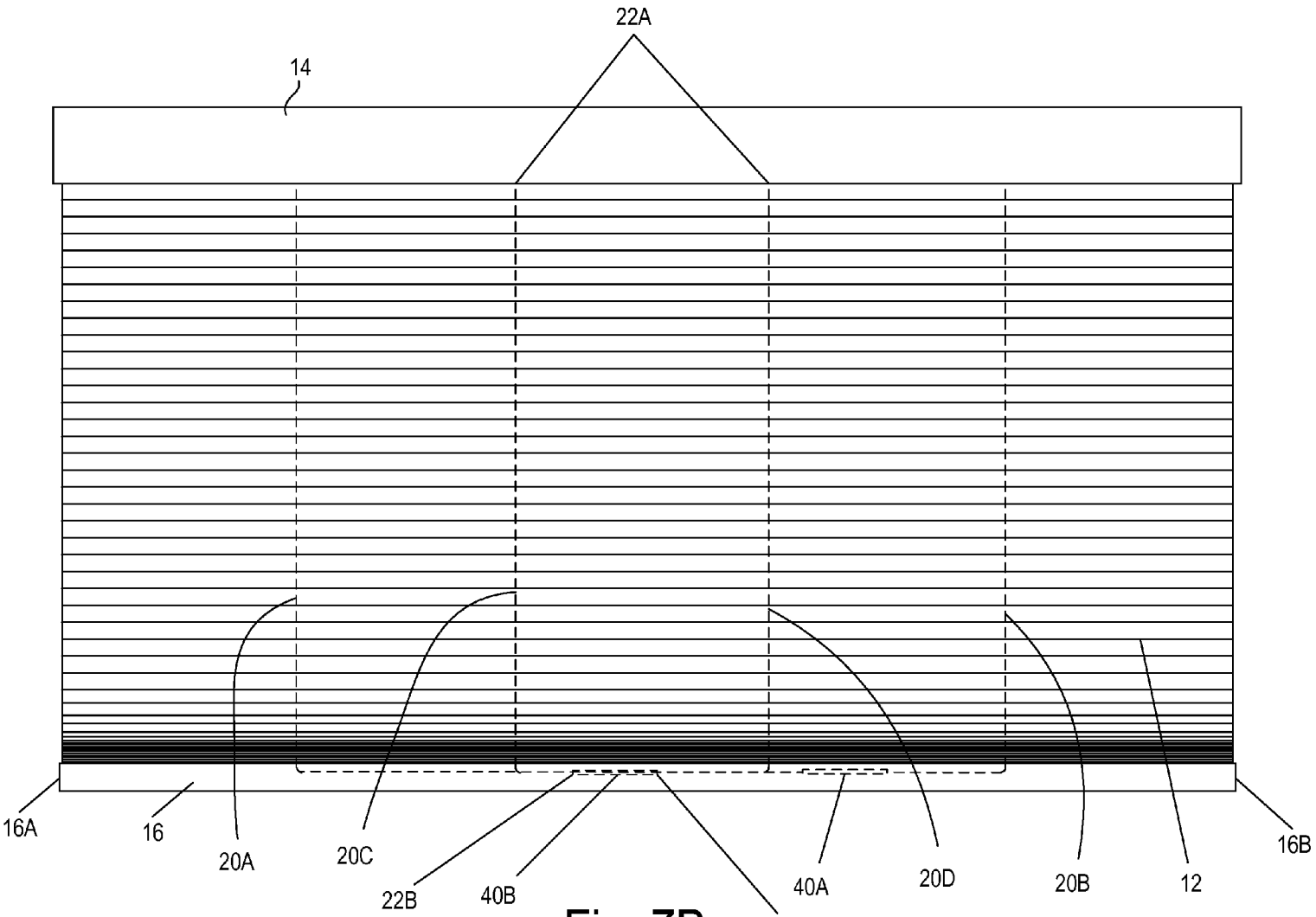
FIG. 7B is a front plan view of a battery-powered motorized window treatment in accordance with another embodiment, the motorized window treatment having four lift cords and two sliding members.

Now in reference to FIG. 7B, the window treatment 10 can further include a fourth lift cord 20D and a second sliding member 40B. The sliding member 40 from the discussion of FIG. 2A will now be referred to as the first sliding member 40A. The sliding member 40A is coupled between the first and second lift cords 20A and 20B. The window treatment 10 as illustrated in FIG. 7B is substantially configured to perform the same functions and movements as the window treatment 10 as shown in FIG. 2A and includes like structure unless otherwise described.

As shown in FIG. 7B, the third and fourth lift cords 20C and 20D are positioned at opposite locations of the headrail 14 along the first direction $L_1$. The third and fourth lift cords 20C and 20D can each have a first end 22A that is operatively attached to the at least one drive shaft 32. It should be appreciated, however, that the motorized window treatment 10 illustrated in FIG. 7B can include a dedicated drive shaft 32 for each lift cord 20. It should further be appreciated that the third and fourth lift cords 20C and 20D can be positioned at any location on the headrail 14 along the first direction $L_1$.

The third and fourth lift cords 20C and 20D can each also include respective second ends 22B that are attached to a respective one of the first and second member ends of the second member body 48 of the second sliding member 40B. Like the first and second lift cords 20A and 20B as previously described, the third and fourth lift cords 20C and 20D may at least partially extend in opposite directions from the first and second member ends of the second sliding member 40B along the third direction $L_2$ and within the channel 42. In this manner, the second sliding member 40B may create a continuous segment between the third and fourth lift cords 20C and 20D. Because the second sliding member 40B may be configured to move along the channel 42 of bottom bar 16, the second sliding member 40B may effectively adjust the length of each of the third and fourth lift cords 20C and 20D with respect to one another. Furthermore, the second sliding member 40B may be configured to move to any location along the channel 42 along the third direction $L_2$. In this manner, the second sliding member 40B may be able to adjust the length of the respective third and fourth lift cords 20C and 20D by a length equal to the distance that the third and fourth lift cords 20C and 20D are spaced apart along the third direction $L_2$.

As shown in FIG. 7B, the first and second sliding members 40A and 40B are moveable within the channel 42 along the third direction $L_2$ such that they may be spaced apart from each other along the third direction $L_2$. Therefore, the first and second sliding members 40A and 40B can be offset from each other along the third direction $L_2$ so that they do not interfere with each other when the bottom bar 16 is being moved from the first relative position to the second relative position. It should also be appreciated that the first and second sliding members 40A and 40B can be substantially identical to each other or can include different structure as desired.

Movement of the bottom bar first end 16A and the bottom bar second end 16B from a first relative position to a second relative position causes the first and second sliding member 40A and 40B to move within the channel along the third direction $L_2$. The movement of the two sliding members may thereby maintain the bottom bar first end 38A and the bottom bar second end 38B in the second relative position. For example, when the bottom bar second end 16B is moved toward the headrail 14 with respect to the bottom bar first end 16A, the first and second sliding member 40A and 40B may slide along the third direction $L_2$ toward bottom bar first end 16A. In this manner, the lengths of the second and fourth lift cords 20B and 20D extending from their respective drive shafts 32 to the bottom bar 16 may decrease. Because the first and second lift cords 20A and 20B are coupled via the first sliding member 40A, and the third and fourth lift cords 20C and 20D are coupled via the second sliding member 40B, the length of the first and third lift cords 20A and 20C extending from their respective drive shafts 32 may increase with respect to the second and fourth lift cords 20B and 20D, respectively. As such, the bottom bar first end 16A may move away from the headrail 14, while the bottom bar second end 16B may move toward the headrail 14 in a length proportional to the length of the bottom bar first end 16A from the headrail 14. It should be appreciated, however, that one of the bar ends 16A and 16B can remain stationary while the other of the bar ends 16A and 16B is moved.

Figure 7C:
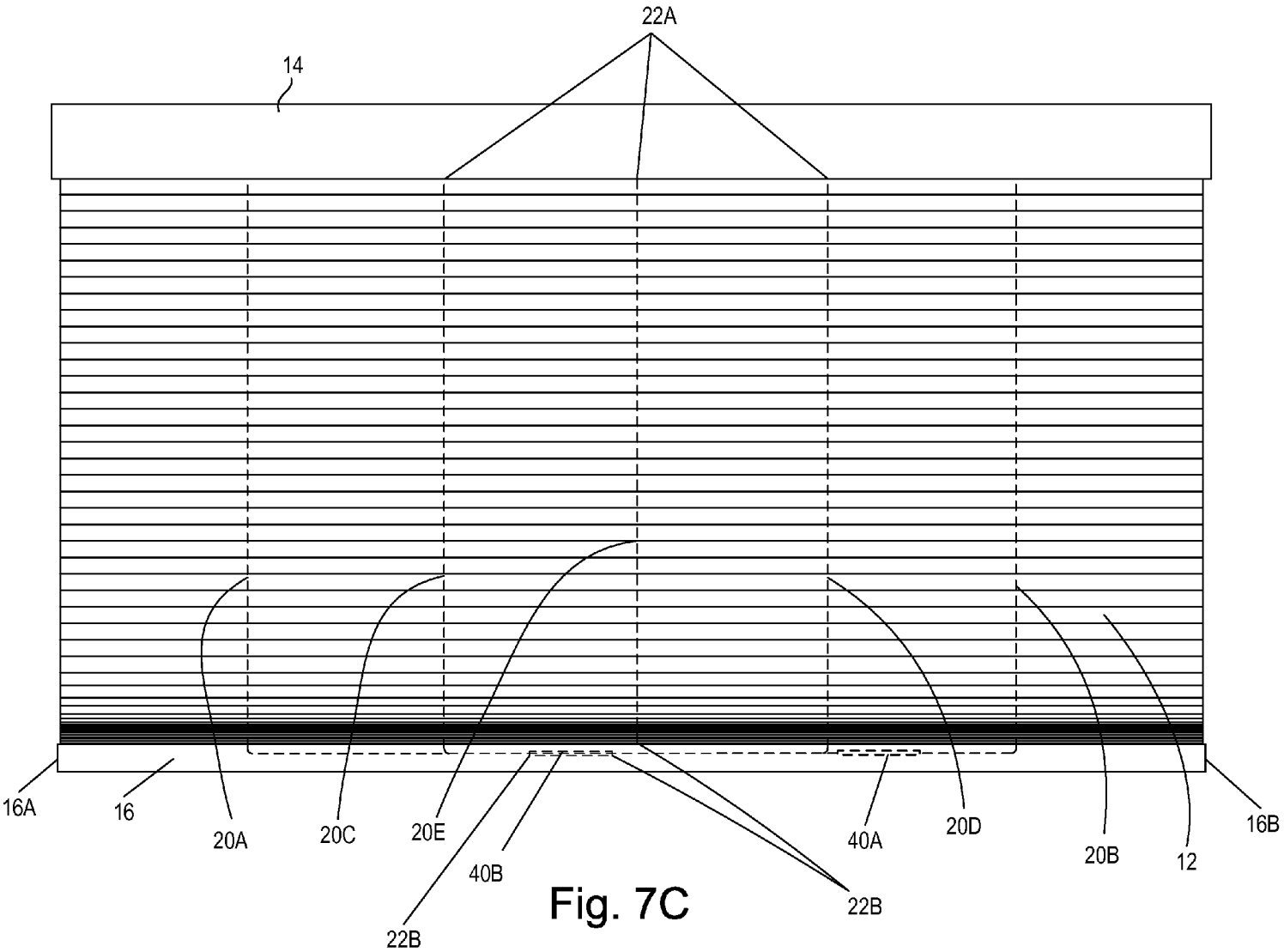
FIG. 7C is a front plan view of a battery-powered motorized window treatment in accordance with another embodiment, the motorized window treatment having five lift cords and two sliding members.

Now in reference to FIG. 7C, the motorized window treatment 10 can further include a fifth lift cord 20E. The fifth lift cord 20E can have a first end 22A that is operatively attached to the at least one drive shaft 32. Furthermore, the fifth lift cord 20E can have a second end 22B that is directly attached to the bottom bar between the third and fourth lift cords 20C and 20D along the third direction $L_2$. The motorized window treatment 10 as illustrated in FIG. 7C is substantially configured to perform the same functions and movements as the window treatment 10 as shown in FIG. 7A. Therefore, like the third lift cord 20C, the fifth lift cord 20E may not be coupled to any sliding member 40 and is instead coupled to the bottom bar 16 directly.

It should be appreciated that the motorized window treatment 10 can include any number of lift cords 20. For example, the motorized window treatment 10 can include six or more lift cords 20 and three or more sliding members 40. Based on the embodiments taught in this disclosure, it will be obvious to the person having ordinary skill in the art how to configure any embodiment to further include any number of lift cords 20 and sliding members 40.

While the foregoing description and drawings represent the preferred embodiment of the present invention, it will be understood that various additions, modifications, combinations and/or substitutions may be made therein without departing from the spirit and scope of the invention as defined in the accompanying claims. In particular, it will be clear to those skilled in the art that the invention may be embodied in other specific forms, structures, arrangements, proportions, and with other elements, materials, and components, without departing from the spirit or essential characteristics thereof. One skilled in the art will appreciate that the invention may be used with many modifications of structure, arrangement, proportions, materials, and components, which are particularly adapted to specific environments and operative requirements without departing from the principles of the invention. In addition, features described herein may be used singularly or in combination with other features. For example, features described in connection with one component may be used and/or interchanged with features described in another component. The presently disclosed embodiment is therefore to be considered in all respects as illustrative and not restrictive, the scope of the invention being indicated by the appended claims, and not limited to the foregoing description.

What is claimed:

1. A window treatment comprising:

a headrail that is elongate along a first direction and is configured to be mounted to a structure, the headrail defining an internal cavity;

a lift mechanism that is mounted within the internal cavity;

a covering material having a top end and a bottom end spaced from the top end along a second direction that is perpendicular to the first direction, the top end of the covering material being attached to the headrail;

a bottom bar attached to the bottom end of the covering material, the bottom bar having a bar body that defines a first bar end and a second bar end that is spaced from the first bar end along a third direction, the bottom bar defining a channel that extends at least partially through the bar body along the third direction;

a sliding member moveable within the channel along the third direction, the sliding member including a member body that defines a first member end and a second member end spaced from the first member end along the third direction; and a first lift cord and a second lift cord, each of the first and second lift cords having a first end that is operatively attached to the lift mechanism, and a respective second end that is attached to a respective one of the first and second member ends of the member body such that rotation of the lift mechanism causes the bottom bar to either move toward or away from the headrail along the second direction, wherein the first and second bar ends are configured to be moved relative to each other along the second direction from a first relative position to a second relative position whereby movement of the first and second bar ends from the first relative position to the second relative position causes the sliding member to move within the channel along the third direction, and wherein the sliding member and the bottom bar are configured to generate a frictional force relative to each other, the frictional force sufficient to maintain the first and second bar ends in the second relative position.

2. The window treatment of claim 1, wherein the third direction is parallel to the first direction when the first and second bar ends are in the second relative position.

3. The window treatment of claim 1, wherein the channel is at least partially defined by opposed first and second sidewalls that extend along the bar body from the first bar end and toward the second bar end and wherein the sliding member is sized to abut the opposed first and second sidewalls as the sliding member moves within the channel.

4. The window treatment of claim 3, wherein the sliding member includes a first biasing member that protrudes from the member body and applies a biasing force against the first sidewall, and a second biasing member that protrudes from the member body and applies a biasing force against the second sidewall.

5. The window treatment of claim 4, wherein the first and second biasing members each includes at least one leg that is spaced from the member body such that each leg flexes toward the member body when the sliding member is inserted into the channel.

6. The window treatment of claim 5, wherein the first biasing member includes a pair of legs that extend away from each other along the third direction and the second biasing member includes a pair of legs that extend away from each other along the third direction.

7. The window treatment of claim 5, wherein each leg defines a protrusion that abuts a respective one of the first and second sidewalls to thereby create a frictional force between the legs and the first and second sidewalls.

8. The window treatment of claim 3, wherein friction between the sliding member and the first and second sidewalls is sufficient to maintain the position of the sliding member within the channel unless the first and second bar ends are moved relative to each other along the second direction.

9. The window treatment of claim 1, wherein the first member end defines a first attachment member configured to attach to the second end of the first lift cord and the second member end defines a second attachment member configured to attach to the second end of the second lift cord.

10. The window treatment of claim 9, wherein the first and second attachment members each define a pair of slits that are configured to receive the second ends of the first and second lift cords respectively to thereby couple the second ends to the sliding member.

11. The window treatment of claim 9, wherein the first and second attachment members each define an aperture configured to receive the second ends of the first and second lift cords respectively to thereby couple the second ends to the sliding member.

12. The window treatment of claim 1, wherein the sliding member is planar.

13. The window treatment of claim 1, further comprising a third lift cord having a first end that is operatively attached to the lift mechanism and a second end that is attached to the bottom bar between the first and second lift cords.

14. The window treatment of claim 1, wherein the sliding member is a first sliding member, the window treatment further comprising, a second sliding member moveable within the channel along the third direction and spaced from the first sliding member along the third direction, the second sliding member including a second member body that defines a first member end and a second member end spaced from the first member end along the third direction; and a third lift cord and a fourth lift cord, each of the third and fourth lift cords having a first end that is operatively attached to the lift mechanism, and a respective second end that is attached to a respective one of the first and second member ends of the second member body, whereby movement of the first and second bar ends from the first relative position to the second relative position causes the first and second sliding members to move within the channel along the third direction, and wherein the second sliding member and the bottom bar are configured to generate a second frictional force relative to each other, and wherein the frictional force and the second frictional force are sufficient to maintain the first and second bar ends in the second relative position.

15. The window treatment of claim 1, wherein the lift mechanism comprises at least one drive shaft, the window treatment further comprising a motor operatively connected to the at least one drive shaft, such that actuation of the motor causes the at least one drive shaft to rotate.

16. The window treatment of claim 15, further comprising first and second lift cord spools that are fixedly attached to the at least one drive shaft, wherein the first ends of the first and second lift cords are attached to the first and second lift cord spools, respectively.

17. The window treatment of claim 16, wherein the at least one drive shaft includes a first drive shaft and a second drive shaft, the first lift cord spool being fixedly attached to the first drive shaft and the second lift cord spool being fixedly attached to the second drive shaft.

18. The window treatment of claim 1, wherein the sliding member and the bottom bar are further configured such that the frictional force may be overcome by a force applied to the bottom bar by a user of the window treatment.

19. The window treatment of claim 1, wherein the first and second lift cords at least partially extend in opposite directions from the first and second member ends along the third direction and within the channel.

20. A window treatment comprising:

a headrail that is elongate along a first direction and is configured to be mounted to a structure, the headrail defining an internal cavity;

a lift mechanism that is mounted within the internal cavity;

a covering material having a top end and a bottom end spaced from the top end along a second direction that is perpendicular to the first direction, the top end of the covering material being attached to the headrail;

a bottom bar attached to the bottom end of the covering material, the bottom bar having a bar body that defines a first bar end and a second bar end that is spaced from the first bar end along a third direction, the bottom bar including opposed first and second internal sidewalls that at least partially define a channel that extends at least partially through the bar body along the third direction;

a sliding member that is movable within the channel along the third direction, the sliding member including a member body, a first biasing member that protrudes from the member body and abuts the first internal sidewall, and a second biasing member that protrudes from the member body and abuts the second internal sidewall; and a first lift cord and a second lift cord, each of the first and second lift cords having a first end that is operatively attached to the lift mechanism, and a respective second end that is attached to the sliding member such that rotation of the lift mechanism causes the bottom bar to either move toward or away from the headrail along the second direction, wherein adjustment of the bottom bar from an unleveled position to a leveled position causes the sliding member to move within the channel along the third direction from a first relative position to a second relative position, and wherein friction between the first and second biasing members and the first and second internal sidewalls retains the sliding member in the second relative position to thereby retain the bottom bar in the leveled position.

21. The window treatment of claim 20, wherein the first and second biasing members each includes at least one leg that is spaced from the member body such that each leg flexes toward the member body when the sliding member is inserted into the channel.

22. The window treatment of claim 21, wherein the first biasing member includes a pair of legs that extend away from each other along the third direction and the second biasing member includes a pair of legs that extend away from each other along the third direction.

23. The window treatment of claim 21, wherein each leg defines a protrusion that abuts a respective one of the first and second sidewalls to thereby create the frictional force between the legs and the first and second sidewalls.

24. The window treatment of claim 20, wherein the member body defines a first member end and a second member end spaced from the first member end along the third direction, and wherein the first member end defines a first attachment member configured to attach to the second end of the first lift cord and the second member end defines a second attachment member configured to attach to the second end of the second lift cord.

25. The window treatment of claim 24, wherein the first and second attachment members each define a pair of slits that are configured to receive the second ends of the first and second lift cords respectively to thereby couple the second ends to the sliding member.

26. The window treatment of claim 24, wherein the first and second attachment members each define an aperture configured to receive the second ends of the first and second lift cords respectively to thereby couple the second ends to the sliding member.

27. The window treatment of claim 24, wherein the first and second lift cords at least partially extend in opposite directions from the sliding member along the third direction and within the channel.

28. The window treatment of claim 20, wherein the sliding member is planar.

29. The window treatment of claim 20, further comprising a third lift cord having a first end that is operatively attached to the lift mechanism and a second end that is attached to the bottom bar between the first and second lift cords.

30. The window treatment of claim 20, wherein the sliding member is a first sliding member, the window treatment further comprising, a second sliding member moveable within the channel along the third direction and spaced from the first sliding member along the third direction, the second sliding member including a second member body that defines a first member end and a second member end spaced from the first member end along the third direction; and a third lift cord and a fourth lift cord, each of the third and fourth lift cords having a first end that is operatively attached to the lift mechanism, and a respective second end that is attached to a respective one of the first and second member ends of the second member body, whereby movement of the first and second bar ends from the first relative position to the second relative position causes the first and second sliding members to move within the channel along the third direction to thereby maintain the first and second bar ends in the second relative position.

31. The window treatment of claim 20, wherein the lift mechanism comprises at least one drive shaft, the window treatment further comprising a motor operatively connected to the at least one drive shaft, such that actuation of the motor causes the at least one drive shaft to rotate.

32. The window treatment of claim 31, further comprising first and second lift cord spools that are fixedly attached to the at least one drive shaft, wherein the first ends of the first and second lift cords are attached to the first and second lift cord spools, respectively.

33. The window treatment of claim 32, wherein the at least one drive shaft includes a first drive shaft and a second drive shaft, the first lift cord spool being fixedly attached to the first drive shaft and the second lift cord spool being fixedly attached to the second drive shaft.

34. The window treatment of claim 20, wherein a user applies force to the bottom bar to adjust the level of the bottom bar along the second direction.

35. The window treatment of claim 20, wherein the third direction is parallel to the first direction when the bottom bar is in the leveled position.

36. A method of adjusting the level of a bottom bar of a window treatment, the bottom bar defining a channel, and the window treatment comprising a sliding member movable within the channel and first and second lift cords attached to the sliding member, the method comprising:

applying a force to the bottom bar of the window treatment to thereby move the bottom bar from an unleveled position to a leveled position; and wherein moving the bottom bar from the unleveled position to the leveled position causes the sliding member to move within the channel from a first position to a second position, and wherein friction between the sliding member and the channel causes the bottom bar to remain in the leveled position.

37. The method of claim 36, wherein applying the force comprises pulling down on an end of the bottom bar.

38. The method of claim 36, wherein the window treatment further comprises a third lift cord between the first and second lift cords.

* * * * *